US005170704A

United States Patent [19]

Warren et al.

[11] Patent Number: 5,170,704

[45] Date of Patent: Dec. 15, 1992

[54] SUBLIMATION PRESS WITH DUAL FLOATING HEADS

[76] Inventors: Dana E. Warren, 4283 W. 111th Cir., Westminster, Colo. 80030; Bruce I. Galler, 3636 Roundtree Ct., Boulder, Colo. 80304

[21] Appl. No.: 665,301

[22] Filed: Mar. 6, 1991

[51] Int. Cl.[5] ..... B41F 17/20

[52] U.S. Cl. ..... 101/41; 8/471; 156/583.1

[58] Field of Search ..... 101/9, 11, 35, 41, 44, 101/487; 8/470, 471; 156/583.3, 583.1

[56] References Cited

U.S. PATENT DOCUMENTS

| | | | |
|---|---|---|---|
| 1,813,878 | 7/1931 | Johnson | 101/9 X |
| 2,643,475 | 6/1953 | Klopfenstein | 156/583.1 X |
| 3,478,680 | 11/1969 | Anderson, Jr. | 101/9 X |
| 3,515,059 | 6/1970 | Sciame | 101/9 X |
| 3,941,050 | 3/1976 | Martindale | 101/11 |
| 4,004,503 | 1/1977 | Dwyer | 101/9 |
| 4,874,454 | 10/1989 | Talalay et al. | 156/359 |
| 4,943,684 | 7/1990 | Kramer | 8/471 X |
| 4,989,508 | 2/1991 | King | 101/9 X |
| 5,019,193 | 5/1991 | Aramini | 156/583.3 X |

*Primary Examiner*—Clifford D. Crowder
*Attorney, Agent, or Firm*—Harness, Dickey & Pierce

[57] ABSTRACT

A sublimation press for providing the necessary heat and pressure to sublimate graphic prints onto an article such as a drinking mug. The press includes a base and an insulating member resting on the base. A press assembly is mounted on the insulating member which includes first and second heads, both having die surfaces conforming to opposite surfaces of the article to be sublimated. The first and second heads also have bottom surfaces which are in sliding contact with the insulating member. A first translating assembly is coupled to the first head for producing horizontal translation in the first head while the head is in sliding contact with the insulating member. A second translating assembly is coupled to the second head for producing horizontal translation in the second head. The second translating assembly includes a position adjusting apparatus and a resilient coupling device disposed between the position adjusting apparatus and the second head for permitting slight horizontal motion between the second head and the position adjusting apparatus. Thus, the sublimation press is relatively easy to adjust to accommodate different size objects. An insulating base in the press helps minimize heat transfer from the heads to the surrounding structure of the press, so the press has a relatively cool exterior temperature.

20 Claims, 2 Drawing Sheets

SUBLIMATION PRESS WITH DUAL FLOATING HEADS

FIELD OF THE INVENTION

This invention relates in general to sublimation presses, and in particular to sublimation presses used to apply graphic images to articles such as drinking mugs, plates, and the like.

BACKGROUND OF THE INVENTION

The use of sublimation presses to apply graphics and photographs to objects such as drinking mugs, has made it possible to personalize such articles at a reasonable cost. Silk screening is an alternative technique which is sometimes used for applying images to such objects in large quantities. However, the initial set-up costs of silk screening would generally be prohibitive for smaller quantities, or for single unit applications.

In general, the sublimation process works by transferring permanent, high-temperature sublimation dies containing a desired photograph or print, onto items such as ceramic mugs, tiles, beer steins and the like. The image is first transferred to a paper mat containing sublimation dies forming the desired image in the desired colors. Using well known techniques, this mat is pressed onto the object using a combination of heat and pressure by means of a device called a sublimation press. This results in a permanent bond between the sublimation dies and the object.

Conventional sublimation presses have a number of drawbacks. Because of the high temperatures (200 to 500 degrees Fahrenheit) normally used for the sublimation process, conventional sublimation presses frequently reach relatively high temperatures on their external surfaces. This is due to the thermal coupling between the heads, especially those that are operated at temperatures between 400° F. and 500° F., and the surrounding parts of the press such as the base and housing. Having external components reach relatively high temperatures poses obvious problems to the user of these presses. Further, high external temperatures restrict the locations in which the press may be placed, since the press can only be used where the heat will not damage or affect surrounding objects. In addition, high temperatures reduce the portability of the sublimation press by limiting the ability to carry the press and limiting the locations where it can be placed. Additional problems with such high temperatures result from heat transfer from the press heads to other portions of the press which reduces the reliability of the press. For example, the useful life of electrical circuitry inside the press is reduced in the presence of high temperatures.

Another drawback with conventional sublimation presses is their restricted ability to adapt to a variety of sizes of objects, such as drinking mugs, or to adapt to different kinds of objects altogether. For example, even among "identical" mugs, size differences occur, for example, among different batches or manufacturing lots. Such size differences will result in variations in the pressure applied by the heads of the sublimation press to the mug. This can result in too much, or too little, head pressure which can adversely affect the sublimation process.

While some conventional sublimation presses do incorporate an adjusting mechanism, in general, it is time consuming for the user to make these adjustments. For example, adjusting head pressure may require removal of the housing, or replacement of the heads entirely, which typically requires the use of one or more hand tools. The complexity of these operations are highly undesirable since the time required for such adjustments reduces the profitability of a sublimation operation.

A second difficulty with respect to the adjustability of conventional sublimation presses arises when it is desired to have a single press sublimate prints onto a variety of different kinds of items such as mugs, tiles, beer steins, plates and other items. Ordinarily, to switch from one kind of item to another requires removal and replacement of the heads. This typically involves removal of the housing of the press to gain access, and the use of tools to remove various fasteners attaching the heads. Having the user exposed to the interior of the press is undesirable due to the electrical components contained within a sublimation press. Further, the time required to change heads often adversely impacts the profitability of the sublimation operation.

In light of the foregoing problems and desires, it is one of the primary objects of the present invention to provide a sublimation press which maintains relatively cool exterior temperatures while in operation.

It is another primary object of the present invention to provide a sublimation press in which the position of the heads is easily adjustable to accommodate minor variations in the sizes of the object being sublimated. In this regard, it is desirable that fine adjustments may be made to the head position, without requiring removal of the housing or the use of tools, to accurately control the clamped press head position and thereby control the sublimation pressure.

One more object of the present invention is to provide a sublimation press which can be adapted to handle different kinds of objects without requiring removal of the press housing, or the removal of the entire press heads. It is further desirable that this conversion can be accomplished in a relatively short period of time by a user.

Still another object of the present invention is to provide a sublimation press which is relatively inexpensive, durable and requires little maintenance.

SUMMARY OF THE INVENTION

In light of the foregoing desires and objects, there is provided in accordance with a first aspect of the present invention, a sublimation press for sublimating a print onto an object, such as a ceramic mug, tile, or other item. The sublimation press provides the necessary heat and pressure to transfer sublimation dyes onto the object. The press comprises a base, and an insulating member resting on the base. A press assembly is mounted on the insulating member, which includes first and second heads, both having die surfaces conforming to opposite surfaces of the article to be sublimated. The first and second heads also have bottom surfaces which are in sliding contact with the insulating member. A first translating assembly is coupled to the first head for inducing horizontal translation of the first head while the head is in sliding contact with the insulating member. The first translating assembly includes an actuatable locking means for preventing sliding motion of the head when in a locked position. Further, a second translating assembly is coupled to the second head for inducing horizontal translation in the second head while the head is in sliding contact with the insulating member. The second translating assembly includes a position adjusting apparatus and a resilient coupling device disposed between the position adjusting apparatus and the second head, for permitting slight horizontal motion between the second head, and the position adjusting apparatus to control maximum pressures applied through both translating assemblies.

BRIEF DESCRIPTION OF THE DRAWINGS

In the accompanying Figures, where like items and features are identified by identical reference numerals in the various Figures:

FIG. 3 is a fragmentary cross-sectional top view of the sublimation press shown in FIG. 1.

DETAILED DESCRIPTION OF THE PREFERRED EMBODIMENT

Figure 1:
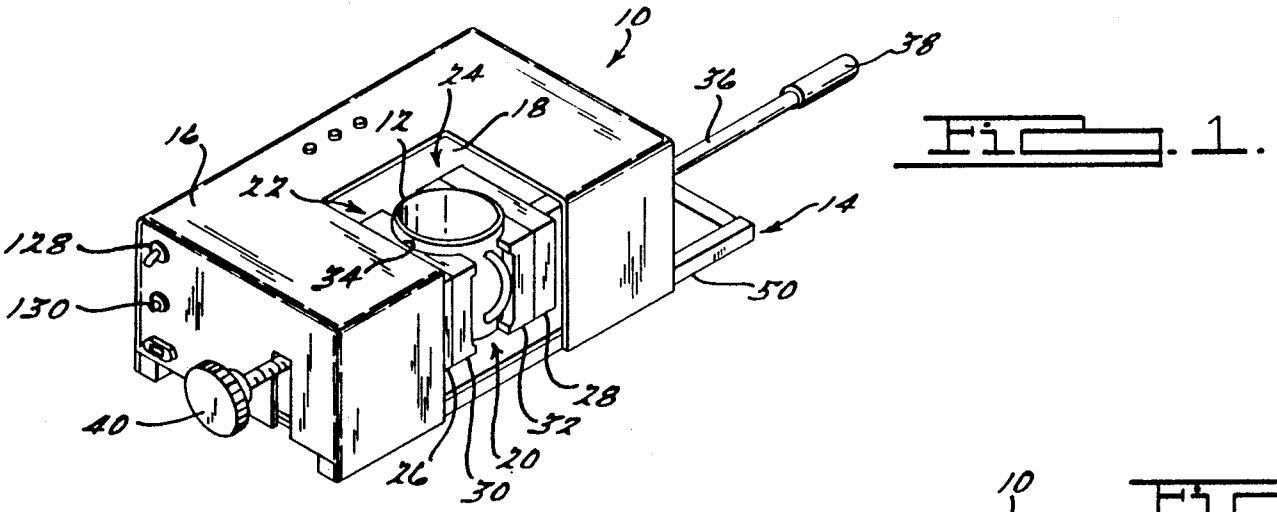
FIG. 1 is a perspective view of the sublimation press in accordance with the present invention.

Referring now to FIG. 1, there is shown a perspective view of the sublimation press 10 of the present invention which is used to sublimate graphic prints onto an article, such as the mug 12 shown. The sublimation press 10 includes a base 14 on which is mounted a rectangular housing 16 having an opening 18 to permit access to selected portions of a press assembly 20 which is mounted on the base 14. The housing 16 shrouds the interior workings of the press 10, and limits user access to only those parts of the press which are necessary to make effective and efficient use of the press. The press assembly 20 includes a set of heads 22 and 24, which include heating blocks 26 and 28 and removable dies 30 and 32. The mug 12 is substantially enclosed on two opposite sides by die surfaces 34 and 36 of the removable dies 30, 32. Flexible, semi-compressible heating pads 33 (shown in FIG. 3) line the die surfaces 34 and 36 and provide for the even application of temperature and pressure to the mug surface 12. Such compliant pads are known in art, and need not be further described here.

In FIG. 1, the sublimation press 10 is depicted in a clamped position with the removable dies 30, 32 pressing against the mug 12. To remove the mug 12, a handle 36 having a hand grip 38, is raised upwardly which causes the head 24 to move to the right, thereby releasing the mug 12. Fine adjustments of the head pressure on the clamped mug 12 may be made by means of handwheel 40.

Figure 2:
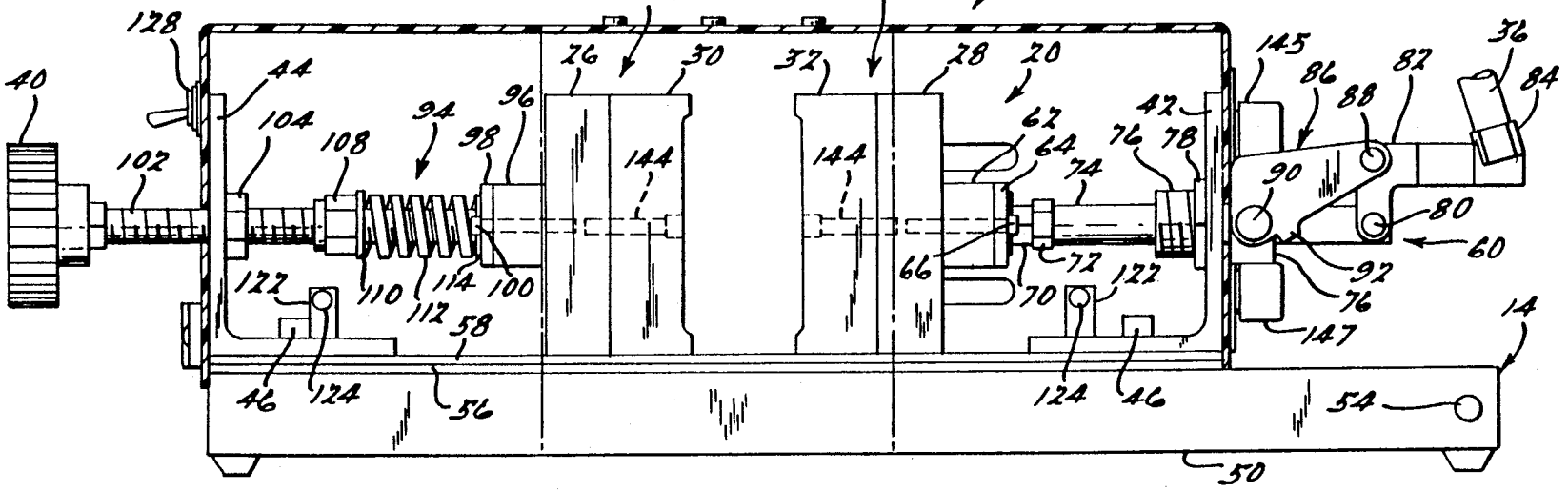
FIG. 2 is a fragmentary cross-sectional frontal view of the sublimation press shown in FIG. 1.
Figure 2:
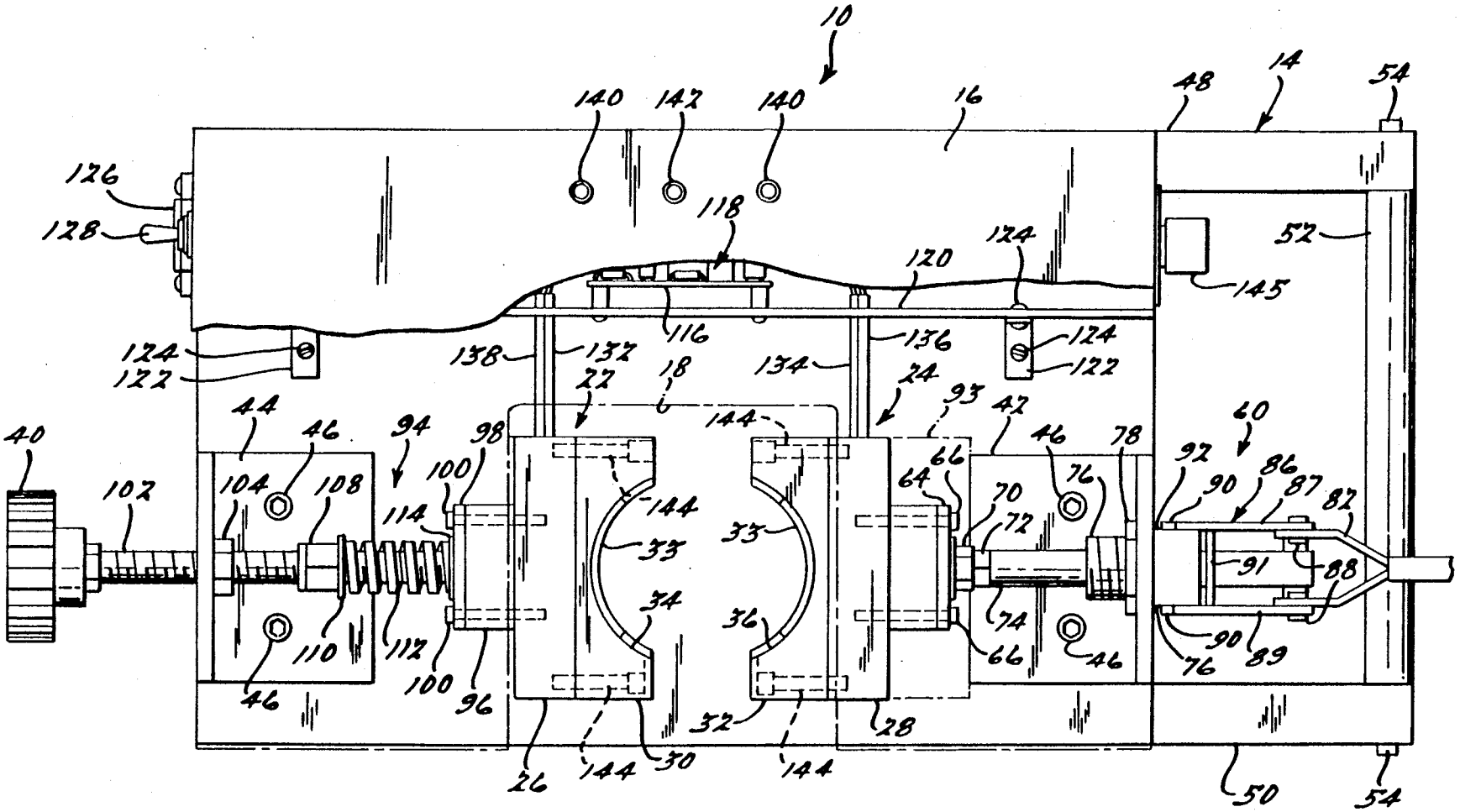

Further details of the sublimation press 10 are shown in FIGS. 2 and 3. A base 14 consists of pair of rails 48 and 50 which are constructed of square channel steel. A base rod member 52 is disposed transversely between one end of the base rails 48 and 50 and is secured by a pair of bolts 54. The base rod 52, besides providing structural stability to the base 14, also serves as a handle for carrying the sublimation press 10.

A base plate 56 is mounted on top of the rails 48 and 50, and an insulating plate 58 is mounted on top of the base plate 56. Insulating plate 58 is preferably made of a material having low thermal conductivity to minimize the transference of heat from the heads 22 and 24 to the base 14 and housing 16. Also, it is desirable that plate 58 have good lubricity characteristics. In one preferred embodiment, insulating plate 58 is made of polytetrafluoroethylene, which is available from E.I. duPont de Nemours & Co. and is sold under the brand name Teflon. Insulating plate 58 is sufficiently thick, for example, at least one fourth inch thick, to provide considerable heat insulating capability. The press assembly 20 is carried by two rigid brackets 42 and 44 preferably of L-shaped cross-section which are mounted to the insulating plate 58 and the base 14 by means of four bolts 46. The heads 22 and 24 rest and slide on the insulating plate 58. Sliding motion of the head 24 is produced by a clamping assembly 60, which is coupled to the head 24 by an insulating block 62, composed of a suitable material having low thermal conductivity, such as polytetrafluoroethylene. The insulating block 62 is disposed between a plate 64 and the heating block 28 to minimize transfer of heat from the heating block 28 to the plate 64. Plate 64 is attached to heating block 28 by means of bolts 66. Attached to plate 64 is a shaft (not shown) having two nuts 70 and 72 threaded onto it. This shaft is threaded into both the plate 64 at one end and a reciprocating shaft 74 at the other end.

Reciprocating shaft 74 is held in a bushing 76, which is inserted into a hole in bracket 42 and secured by means of a nut 78. Bushing 76, having an inside bore corresponding to the outside bore of reciprocating shaft 74, holds shaft 74 while permitting sliding motion therein. At one end of reciprocating shaft 74 is a pivot pin 80 which holds a clevis 82 to the shaft 74 and permits rotation of the clevis 82 about pivot pin 80. Clevis 82 has a handle socket 84 at its other end which receives handle 36. In addition, dual lever assembly 86 is attached to clevis 82 by means of a pair of pivot pins 88 and is also attached to bushing 76 by means of pivot pins 90. Dual lever assembly 86 includes a pair of levers 87 and 89 attached by means of pen 91. Dual lever assembly 86 also includes a pair of flanges 92 which engage with bushing 76 to limit angular motion of handle 36, as may be seen in FIG. 2.

It will be appreciated that clamping assembly 60 will cause the head 24 to slide to the right, that is disengage from mug 12, when handle 36 is pulled upwardly, i.e., rotated in a counterclockwise direction as viewed in FIG. 2. The extreme limit of motion of head 24 in this direction is reached when heating block 28 makes contact with bracket 42 as shown by dashed lines 93. It will also be appreciated that clamping assembly 60 provides considerable leverage for the user to apply a significant amount of force onto mug 12 by head 24 when handle 36 is brought downward, i.e., rotated clockwise when viewed as in FIG. 2. Further, an important feature of clamping assembly 60 is that it provides a latched clamping force when handle 36 is in the down position, as shown in FIG. 1. In that position, flange 92 is in contact with bushing 76 and head 24 is locked in a rigid position after handle 36 is released. It should also be noted that while head 24 may reach extreme temperatures, such as 450° F., insulating block 62 prevents any significant transfer of heat to the clamping assembly 60. In addition, insulating plate 58 likewise prevents significant transference of heat from the head 24 to the base 14. As a result, base 14, clamping assembly 60 and housing 16 all remain at relatively low temperatures.

In conventional sublimation presses only one head moves. In other words, one head of a conventional press, for example, head 22, opposite the clamped head 24, is mounted in a rigid, fixed position which can only be adjusted through the use of one or more tools after removing the cover or housing of the press. However, the present invention utilizes a floating head 22. This minimizes the transfer of heat from head 22, due to the sliding motion and lack of a rigid mechanical coupling to the base, and also permits the clamping pressure to be fine-tuned. In more detail, head 22 is attached to a position adjusting assembly 94 which in turn is attached to heating block 26 through a second thermally insulating block 96. A plate 98 is attached to insulated block 96 and heating block 26 by means of a pair of bolts 100. Adjusting screw 102 is threaded into bracket 44 and also into nut 104 which is welded to bracket 44. A handwheel 40 permits manually turning adjusting screw 102.

To assemble the adjusting assembly 94, a nut 108 is threaded onto adjustment screw 102 to a predetermined position. Washer 110 and spring 112, as well as washer 114, are slipped over adjustment screw 102 as shown in FIGS. 2 and 3. The right end of adjustment screw 102 is then inserted into a bore in plate 98 until plate 98 is adjacent to washer 114. Next, a washer and nut (not shown) are attached to the right end of adjustment screw 102 and the nut tightened until the nut and washer (not shown) as well as plate 98 washer 114, spring 112, washer 110, and nut 108 all press against each other. The nut (not shown) is preferably tightened until the spring 112 is compressed slightly.

Insulating block 96, as well as heating block 26 both have a bore drilled into them which is large enough to permit insertion of the nut and washer (not shown) attached to the extreme right end of the adjustment screw 102. Thus, when plate 98 is bolted onto insulated block 96 by means of screws 100, this nut and washer at the extreme end of adjustment screw 102 are inserted into the bore in insulating block 96. It should be noted that when handwheel 40 is turned, the nut 108, washer 110, spring 112, and washer 114, all turn freely along with the adjustment screw 102. The plate 98 being bolted to heating block 26 does not turn, while the nut and washer (not shown) inside insulating block 96 are free to turn.

When handwheel 40 is turned clockwise (as viewed from the perspective of FIG. 2), head 22 will slide along insulating plate 58 to the right. When a mug 12 is inserted between heads 22 and 24, it offers resistance to motion of the head 22 once the die surface 34 makes contact with the mug 12. If handwheel 40 is turned further, mug 12 prevents further motion of head 22, but spring 112 will compress, thus permitting adjustment screw 102 to continue to turn and proceed to the right. Thus, the end of adjustment screw 102, having the nut and washer (not shown) on the end, will then continue to move deeper into the bore of block 96 and heating block 26. It should be noted that when handwheel 40 is then turned counterclockwise, spring 112 decompresses, and the washer (not shown) inside block 96 again comes in contact with the inner face of plate 98 and prevents head 22 and block 96 from separating from the position adjusting assembly 94.

To use the position adjusting assembly 94, the user turns the handwheel 40 clockwise to increase sublimation pressure, or turns it counterclockwise to decrease the pressure. For example, first the user inserts the mug 12 into the press with the handle 36 in the upper position, that is, with head 22 in the open position. Then, the user may adjust, or fine-tune, the pressure on the mug by pulling the handle 36 downwardly to its extreme lower position, and adjusting handwheel 40 until a predetermined or desired pressure is placed on the mug. For example, one procedure which may be followed is to initially turn handwheel 40 counterclockwise until no contact is made with the mug with the handle 36 in its clamped position, and then to turn handwheel 40 until the die surface 34 first makes contact with the mug. The handwheel 40 may then be turned clockwise a predetermined number of rotations to exert a predetermined repeatable desired force on mug 12 in the clamped position. Thus, in this way while mug diameters may vary slightly due to differences in manufacturing lots, the sublimation pressure on the mug 12 may be fine-tuned to be a predetermined amount for the particular nominal mug size. It is notable that this adjustment may be made entirely by hand by the user without the use of tools and without removing the housing 16.

As noted above, in conventional sublimation presses the left head 22 is in a fixed position and only the right head 24 is moved. Thus, in such presses there is only one size of mug for which correct sublimation pressure will be applied without making manual adjustments. On the other hand, with the press 10 of the present invention, even without making any adjustments, the spring 112 permits the sublimation press to apply relatively equal pressure within a small range of mug sizes. That is, with slightly larger mugs 12 the spring 112 will compressed to a greater degree than with smaller mugs within a given range in the clamped position. Of course, as spring 112 is compresswed the amount of force does increase somewhat for larger size mugs in the absence of any manual adjustments. On the other hand, in prior presses where the head 22 is fixed, there is almost no compliance, and clamping an oversize mug could result in much greater than desired pressure, and might even damage the mug or place undue strain on the press.

To apply and control heat to the heads 22 and 24, a circuit board 116 containing an electrical circuit 118 is mounted onto a mounting board 120, which also acts to limit the transfer of heat by convection from heads 22 and 24 to the circuit 118. Mounting board 120 is attached to the insulating plate 58 by means of brackets 122 and bolts 124. Circuit 118 receives electrical power from a conventional 120 volt power line (not shown) plugged into socket 126. An on/off switch 128 is used to turn electrical power on and off. A circuit breaker 130 is employed to disconnect electrical power if an overload situation should occur. Heating elements (not shown) inside the heating blocks 25, 26 receive power by means of electrical conductors 132 and 134 which are coupled to the circuit 118. Conventional thermistors (not shown) also inside of the heating blocks 26 and 28 are coupled to the circuit 118 by means of conductors 136 and 138. In this way, circuit 118 is able to direct electrical power to the heating blocks 26 and 28 through conductors 132 and 134 as well as control the internal temperature in the heating blocks 26 and 28 by means of the thermistors (not shown) coupled to the circuit 118 through conductors 136 and 138. It will be appreciated by those skilled in the art that circuit 118 may be constructed from conventional electrical components to provide the desired current to conductors 132 and 134 as well as to sense temperature from the thermistors along conductors 136 and 138. In this way, circuit 118 is able to turn the current off to the heating elements when a preset upper temperature limit is reached, and also, to turn the current on again when a predetermined lower temperature is limit reached, thereby maintaining heating blocks 26 and 28 within a preset temperature range. This type of temperature control system is known to builders of sublimation presses, and need not be further described here.

Indicator lights 140 are used to indicate when the heads are heating and indicator light 142 is used to indicate that the power is on. Knobs 145 and 147 attached to a pair of potentiometers (not shown) are coupled to the circuit 118 and are used to set the desired temperatures for head 22 and 24 respectively.

Referring now to FIG. 3, it can be seen that removable dies 30, and 32 are attached to heating blocks 26 and 28 by means of bolts 144. In a preferred embodiment, bolts 144 are allen head bolts which permit them to be mounted in removable dies 30 and 32 in a recessed position so as to avoid interference with the closing of the dies 30, and 32. Moreover, the use of allen head bolts facilitates their easy removal by hand through opening 18 by means of conventional allen wrenches. In this way removable dies 30 and 32 can be easily removed and replaced with different dies having different die surfaces without removing the housing 16. This is desirable, for example, to permit the user to use the sublimation press 10 for different size mugs, or to switch to different kinds of articles altogether, such as plates. The conversion is accomplished by simply removing four bolts 144, removing the dies 30 and 32, and replacing them with new dies and replacing the bolts 144. Since the housing 16 does not need to be removed, the amount of time required for die change-over is reduced.

The forgoing detailed description shows that the preferred embodiments of the present invention are well suited to fulfill the objects stated above. It is recognized that those skilled in the art may make various modifications or additions to the preferred embodiments chosen to illustrate the present invention without departing from the true spirit and proper scope thereof. Accordingly, it is to be understood that the protection sought and to be afforded hereby should be deemed to extend to the subject matter defined by the appended claims, including all fair equivalents thereof.

We claim:

1. A sublimation press for applying a graphic print to an article, said press comprising:

a base;

an insulating member on said base;

first and second heads both having die surfaces conforming to opposite surfaces of said article, said first and second heads also having bottom surfaces in sliding contact with said insulating member;

a first translating means coupled to said first head for inducing horizontal translation of said first head while in sliding contact with said insulating member, said translation being between a first open position wherein said head is adapted to accept said article and a second closed position wherein said head is adapted to engage and apply pressure to said article, said first translating means including an actuable locking means for preventing sliding motion of said first head when locked in said second closed position; and a second translating means coupled to said second head for inducing small horizontal adjustments in the position of said second head while in sliding contact with said insulating member, said second translating means including a position adjusting means having a resilient coupling member disposed between said position adjusting means and said second head for permitting slight horizontal motion between said second head and said position adjusting means whereby said second translating means permits said press to accommodate minor variations in the size of said article.

2. The press of claim 1 wherein said insulating member comprises a planar slab of a material having a low thermal conductivity.

3. The press of claim 2 wherein said insulating member includes polytetrafluoroethylene.

4. The press of claim 1 further comprising second and third insulating members each disposed between said first and second heads and said first and second translating means respectively, said second and third insulating members having low thermal conductivity.

5. The press of claim 4 wherein said second and third insulating members are made of polytetrafluoroethylene.

6. The press of claim 1 wherein said first translating means further comprises a clamping assembly including a first rod having a hand grip, a second rod coupled to said first head, a bracket mounted to said insulating member and said base, and a multiple pivot means for translating angular motion of said first rod into linear motion of said second rod and said first head.

7. The press of claim 1 wherein said position adjusting means further comprises a threadable rod, a bracket mounted to said insulating member and threadably carrying said threaded rod, and a handwheel coupled to said threaded rod for inducing translating motion in said threaded rod, said resilient coupling member and said second head.

8. The press of claim 1 wherein said first and second heads each comprise a heater block base and a removable die portion, said die surface being disposed on said removable die portion, said first and second heads further comprising fastening means for attaching said removable die portion to said heater block portion.

9. The press of claim 8 further comprising a housing substantially covering said base, insulating member, and first and second translating means, said housing including an opening to permit access to said first and second heads and also to said fastening means, whereby said removable die portion can be removed while said housing is in place.

10. The press of claim 1 further comprising a pair of heating elements disposed within said heater blocks, an electrical circuit for providing current to said heater blocks, and a thermostat means disposed in at least one of said heater blocks, coupled to said electrical circuit for turning off said circuit when a predetermined temperature is reached.

11. A sublimation press comprising:

first and second heads both having die surfaces conforming to opposite surfaces of an article wherein said first and second heads each comprising a heater block and a removable die portion, said die surface being disposed on said removable die portion, said first and second heads further comprising fastening means for attaching said removable die portion to said heater block portion;

means for heating said heads;

a first translating means coupled to said first head for inducing horizontal translation of said first head said translation being between a first open position wherein said head is adapted to accept said article and a second closed position wherein said head is adapted to engage and apply pressure to said article;

said first translating means including an actuable locking means for preventing said sliding motion when locked in said second closed position; and a second translating means coupled to second head for inducing small horizontal adjustments in the position of said second head, said second translating means including a position adjusting means having a resilient coupling member disposed between said position adjusting means and said second head for permitting slight horizontal motion between said second head and said position adjusting means whereby said second translating means permits said press to accommodate minor variations in the size of said article.

12. The press of claim 11 further comprising a base and an insulating member comprising a planar slab on said base, said insulating member being made of a material having a low thermal conductivity wherein said first and second heads rest on said insulating member.

13. The press of claim 12 wherein said insulating member is made of polytetrafluoroethylene.

14. The press of claim 12 further comprising second and third insulating members each disposed between said first and second heads and said first and second translating means respectively, said second and third insulating members having low thermal conductivity.

15. The press of claim 14 wherein said second and third insulating members are made of polytetrafluoroethylene.

16. The press of claim 11 wherein said first translating means further comprises a clamping assembly including a first rod having a hand grip, a second rod coupled to said first head, a bracket mounted to said insulating member, and a multiple pivot means for translating angular motion of said first rod into linear motion of said second rod and said first head.

17. The press of claim 11 wherein said position adjusting means further comprises a threadable rod, a bracket mounted to said insulating member having a threaded opening carrying said threaded rod, and a handwheel coupled to said threaded rod for inducing translating motion in said threaded rod, said resilient coupling member and said second head.

18. The press of claim 11 wherein said means for heating said heads further comprises:

a pair of heating elements disposed within said heater blocks an electrical circuit for providing current to said heater blocks; and a thermostat means disposed in at least one of said heater blocks coupled to said electrical circuit for turning off said circuit for when a predetermined temperature is reached.

19. The press of claim 11 further comprising a housing substantially covering said base, insulating member, and first and second translating means, said housing including an opening to permit access to said first and second heads and also to said fastening means, whereby said removable die portion can be remove while said housing is in place.

20. A sublimation press for applying a graphic print to a mug, said press comprising:

a base;

an insulating member consisting of a planar slab of polytetrafluoroethylene on said base;

first and second heads, each comprising a heater block and a removable die portion, said removable die portion having a die surface which conforms to opposite surfaces of the mug;

a recessed fastening means for attaching said removable die portion to said heater block;

means for heating said heads; including an electrical circuit for providing current to said heater blocks, and a thermostat means disposed in at least one of said heater blocks coupled to said electrical circuit for maintaining said heater block within a predetermined temperature range;

said first and second heads having bottom surfaces in sliding contact with said insulating member;

a first translating means coupled to said first head for inducing horizontal translation in said first head while in sliding contact with said insulating member, said first translating means comprising a clamping assembly including a first rod having a hand grip, a second rod coupled to said first head, a bracket mounted to said insulating member, and a multiple pivot means for translating angular motion of said first rod into linear motion of said second rod and said first head; and a second translating means coupled to said second head for inducing horizontal translation an said second head while in sliding contact with said insulating member, said second translating means including a position adjusting means having a resilient coupling member disposed between said position adjusting means and said second head for permitting slight horizontal motion between said second head and said position adjusting means.

* * * * *